US012740682B2

(12) United States Patent
Hamm et al.

(10) Patent No.: US 12,740,682 B2
(45) Date of Patent: Sep. 22, 2026

(54) ELECTRIC BURNISHER

(71) Applicant: Amano Pioneer Eclipse Corporation, Sparta, NC (US)

(72) Inventors: Derrick Lee Hamm, Sparta, NC (US); Mickey J. Hall, Sparta, NC (US); Ted Tilman Wagoner, Ennice, NC (US)

(73) Assignee: Amano Pioneer Eclipse Corporation, Sparta, NC (US)

( * ) Notice: Subject to any disclaimer, the term of this patent is extended or adjusted under 35 U.S.C. 154(b) by 572 days.

(21) Appl. No.: 18/187,951

(22) Filed: Mar. 22, 2023

(65) Prior Publication Data

US 2023/0301480 A1 Sep. 28, 2023

Related U.S. Application Data

(60) Provisional application No. 63/269,783, filed on Mar. 23, 2022.

(51) Int. Cl.
*A47L 11/14* (2006.01)
*A47L 11/40* (2006.01)

(52) U.S. Cl.
CPC ..... *A47L 11/14* (2013.01); *A47L 11/4005* (2013.01); *A47L 11/4008* (2013.01); *A47L 11/4011* (2013.01); *A47L 11/4038* (2013.01); *A47L 11/4069* (2013.01); *A47L 11/4075* (2013.01)

(58) Field of Classification Search
CPC ..... A47L 11/02; A47L 11/10; A47L 11/144; A47L 11/4002; A47L 11/4005; A47L 11/4008; A47L 11/4011; A47L 11/4038; A47L 11/4069; A47L 11/4075
See application file for complete search history.

(56) References Cited

U.S. PATENT DOCUMENTS

| | | | | |
|---|---|---|---|---|
| 4,675,935 A * | 6/1987 | Kasper | A47L 11/4011 | 15/319 |
| 2009/0094784 A1* | 4/2009 | Pedlar | A47L 11/292 | 15/340.1 |
| 2014/0173864 A1* | 6/2014 | Hamm | B24B 7/186 | 29/90.01 |
| 2015/0265124 A1* | 9/2015 | Chen | A47L 11/4055 | 705/305 |

FOREIGN PATENT DOCUMENTS

| | | | | |
|---|---|---|---|---|
| CN | 209690754 U * | 11/2019 | | |
| CN | 112336257 A * | 2/2021 | A47L 11/4088 | |
| JP | 2005160958 A * | 6/2005 | | |
| WO | WO-2021237336 A1 * | 12/2021 | A47L 11/4002 | |

* cited by examiner

*Primary Examiner* — C. A. Rivera
(74) *Attorney, Agent, or Firm* — Husch Blackwell LLP

(57) ABSTRACT

A burnisher for cleaning and polishing floors is provided. The burnisher includes at least one electric motor powered by at least one battery. The at least one battery can be provided as one or more lithium ion batteries. The burnisher is configured to rotate a burnisher pad at various speeds, as selected by the operator. The burnisher includes a control area including various input and output devices that can control the burnisher and provide information regarding operational parameters of the burnisher, respectively. The control area further includes a touchscreen display that allows the operator to direct the operation of the burnisher.

19 Claims, 5 Drawing Sheets

PRIOR
ART

PRIOR
ART

ELECTRIC BURNISHER

CROSS-REFERENCE TO RELATED APPLICATIONS

This application claims priority to U.S. Provisional Patent Application Ser. No. 63/269,783, filed on Mar. 23, 2022, entitled "ELECTRIC BURNISHER," currently pending, the entire disclosure of which is incorporated herein by reference.

FIELD OF INVENTION

The present invention relates generally to a burnisher for cleaning floors and more specifically to an electric burnisher including at least one rechargeable battery and variable speed control of the burnishing pad.

BACKGROUND OF INVENTION

Building floors in high-traffic areas quickly become dirty as people walk over them and debris settles on them. After floors have been cleaned via mops, automatic scrubbing machines, or other cleaning devices, a burnisher is used to repair scratches in the floor and improve the floor's durability and appearance. Consumers often use burnishers on indoor hard floor surfaces in residential, commercial, governmental, and industrial settings.

High-speed floor burnishers have been commercially available since the late 1970s. The burnishers typically include a pad arranged to contact the floor during the cleaning process. When cleaning the surface, the pad rotates at a minimum speed of 1,000 rotations per minute. To achieve such high rates of rotation, traditional burnishers are powered by internal combustion engines, AC electricity provided via power cords, or DC electricity provided via lead-acid batteries. Many consumers no longer use burnishers powered by AC electricity because the burnisher must be used near an outlet, significantly limiting the physical range of the burnisher. In comparison, burnishers powered by engines and lead-acid batteries are not so limited and can be interchangeably used in certain applications. For example, someone tasked with burnishing a grocery store could use either an engine powered or lead-acid battery powered burnisher.

Burnishers powered by engines (such as the burnisher illustrated in FIG. 1) have certain benefits compared to burnishers powered by lead-acid batteries. Such benefits include providing greater power to the pad for cleaning; minimal downtime for energy replenishment because a fuel cylinder exchange may take only minutes; and variable pad speed control. In sum, burnishers powered by engines may have better performance and productivity than electric burnishers. On the other hand, burnishers powered by lead-acid batteries (such as the burnisher illustrated in FIG. 2) are quieter during operation, produce no exhaust or emissions during normal operation, and have lower maintenance costs than engine powered burnishers.

However, even though they are typically used more often than AC powered burnishers, both lead-acid battery and engine powered burnishers present issues for consumers. Engine powered burnishers require a fuel source (e.g., propane cylinders) to be readily available for refueling. Such fuel sources are not convenient for consumers to obtain and can be difficult for consumers to remove and couple to the burnisher. Further, the exhaust of engine powered burnishers may include toxic fumes, which can harm the consumer if he or she uses the burnisher in an enclosed, unventilated space. Finally, burnishers powered by engines can be difficult to maintain due to the many components associated with the internal combustion engine powering the burnisher.

In comparison, lead-acid battery powered burnishers do not currently include adjustable or variable speed control for the burnishing pad, making it challenging to clean multiple surfaces with a single burnisher or burnisher pad. The burnishing pad is rotated by an electric motor that may be connected to the pad via a belt and pulley system or directly via a pad holder. In either scenario, the motor is energized and rotating at a predetermined speed, or the motor is de-energized and stationary. In addition, lead-acid batteries can leak sulfuric acid and can emit toxic fumes if the electrolyte is overheated during charging, which presents significant safety hazards for consumers.

SUMMARY OF INVENTION

The present invention overcomes many of the shortcomings and limitations of the prior art devices discussed above. The invention described includes several embodiments of an electric burnisher provided in the form of at least one battery, a motor coupled to a burnishing pad, and variable speed control for the burnishing pad. The electric burnisher may include at least one input device configured to control the speed of the motor coupled to the burnishing pad, such as a hand throttle or an LCD display. The motor may be connected to the burnishing pad via a drive train comprising a belt and at least one pulley. Advantageously, and unlike prior art battery-powered burnishers, as the motor speed changes in response to the throttling carried out by the user, the pad speed changes. Further, the variable pad speed functionality may be supported by providing lithium ion batteries on the electric burnisher, since lithium ion batteries can adapt the amount of energy supplied or applied to the motor.

The effectiveness of burnishing a floor is a function of various direct and indirect factors relative to the machine. The indirect factors include, but are not limited to, the type of flooring, the coating applied to the floor, and various environmental conditions. Direct factors include, for example, the downward force applied to the burnishing pad, the pad type, and the pad's speed. The prior art battery-powered burnishers cannot control the pad speed. By adjusting the pad speed, the electric burnisher described herein can be configured to accommodate various types of floor coatings, pad types, environmental conditions, and operator ability to effectively clean floors. These and other aspects and advantages of the present invention will become apparent to those skilled in the art after considering the following detailed description in connection with the accompanying drawings.

Figure 1:
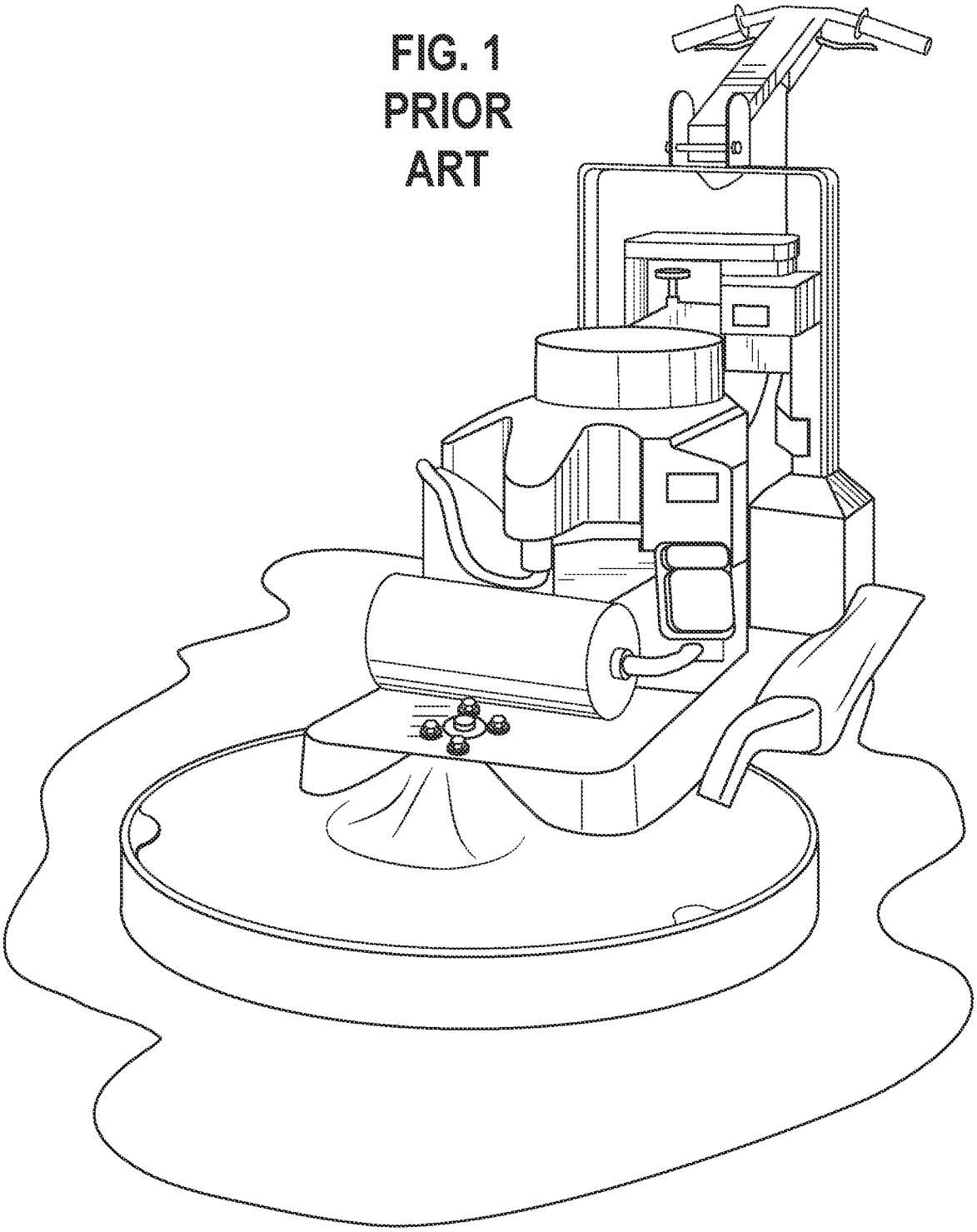
FIG. 1 is a perspective view of a prior art engine powered burnisher.
Figure 2:
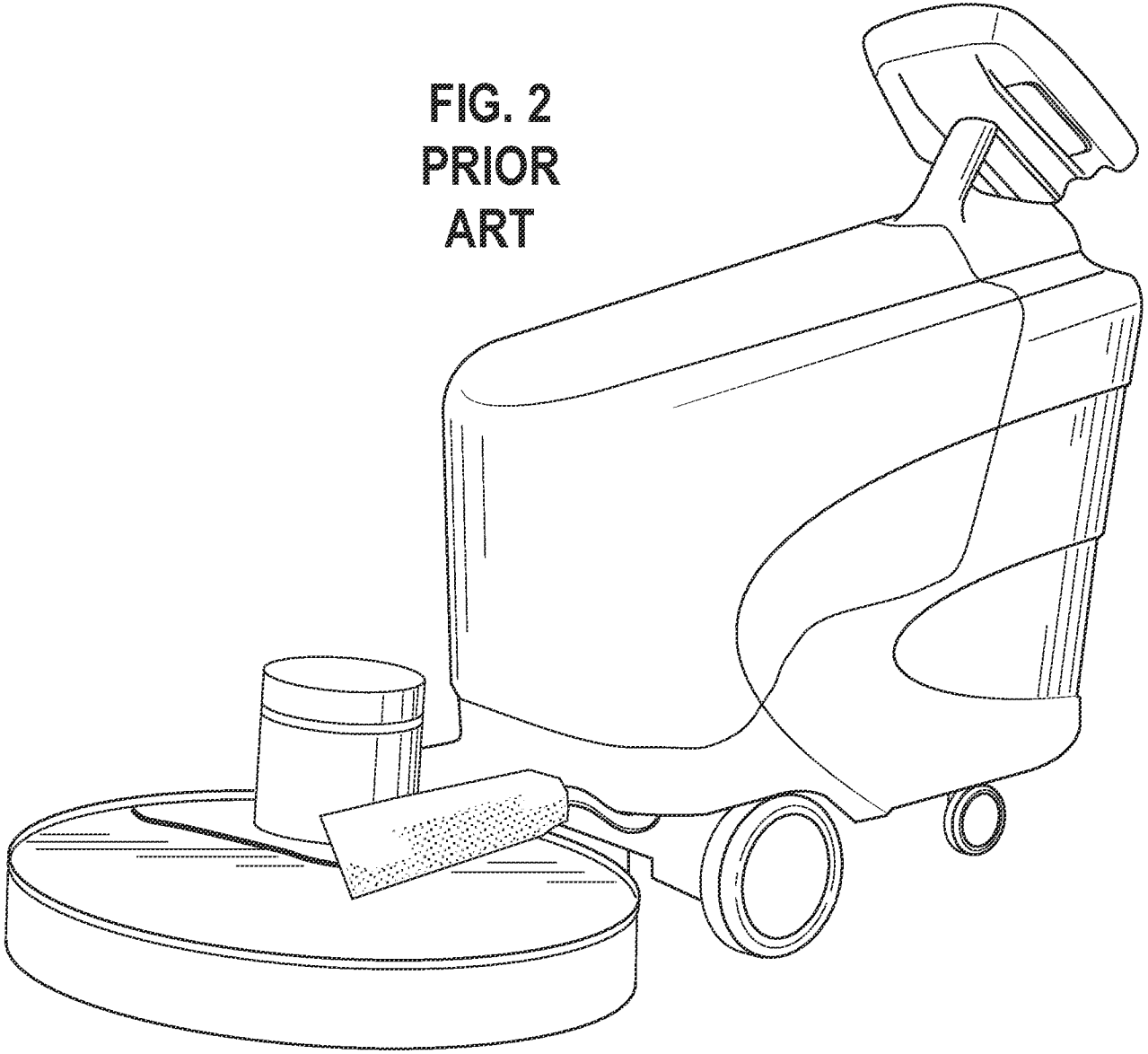
FIG. 2 is a perspective view of a prior art lead-acid battery powered burnisher.

While the disclosure is susceptible to various modifications and alternative forms, a specific embodiment thereof is shown by way of example in the drawings and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Figure 3:
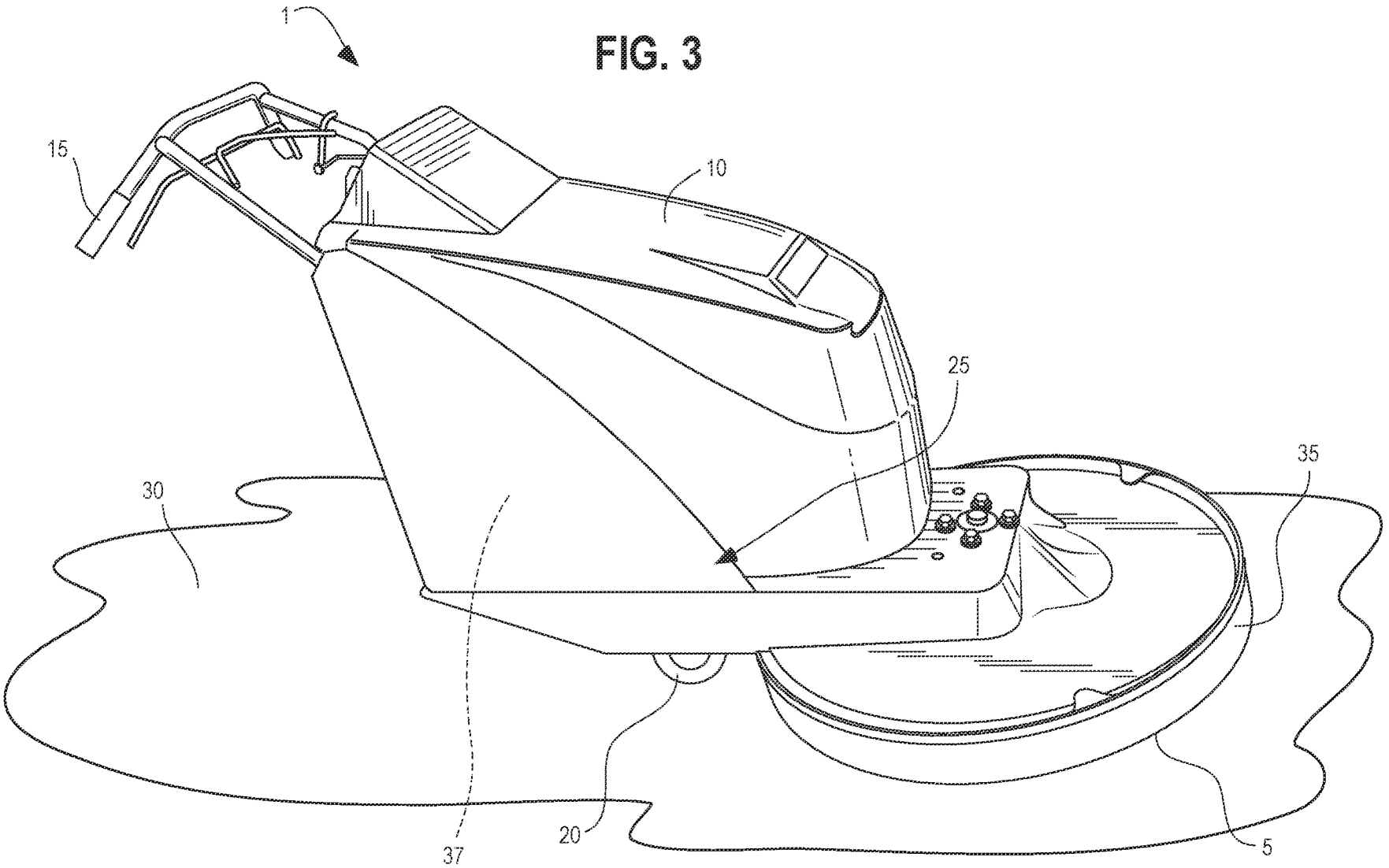
FIG. 3 is a perspective view of a burnisher constructed according to the teachings of the present disclosure.

FIG. 3 illustrates a battery-powered burnisher 1 (hereinafter, the "burnisher 1") including a pad 5 coupled to a body 10 of the burnisher 1, the pad 5 configured to clean and polish hard floor surfaces. The body 10 may be provided as a three-dimensional structure configured to house or couple to components of the burnisher 1. For example, handles 15 and wheels 20 may be coupled to the body 10 and/or one or more motors (not illustrated) may be housed within the body 10. The handles 15 may protrude outwardly and away from the body 10 of the burnisher 1 and may assist the operator in steering the burnisher 1 and/or providing a downward force to the pad 5. The wheels 20 may be coupled to a bottom portion 25 of the body 10 such that the wheels 20 may contact a surface 30. The wheels 20 may assist an operator in moving the burnisher 1 along the surface 30 by reducing the amount of friction between the burnisher 1 and the surface 30. Furthermore, the handles 15 may include at least one input device configured to help an operator adjust the rotational speed of the pad 5 and/or turn the burnisher 1 on and off, as explained in more detail below.

A pad holder 35 may be coupled to the body 10 of the burnisher 1 and may be configured to receive and couple to the pad 5. The pad holder 35 may be provided as a cylinder with an opening at one end such that the pad 5 may be received therein, although other forms for the pad holder 35 are foreseeable. The pad holder 35 may be positioned and located on the bottom portion 25 of the body 10 such that the pad 5 may contact the surface 30 when the burnisher 1 is used. The pad holder 35, through known mechanisms, may be configured to rotate the pad 5 at high speeds (e.g., at speeds of at least 1000 rotations per minute, or at speeds of 1000 to 3000 rotations per minute). Rotating the pad 5 at high speeds may help the pad 5 remove scratches from and improve the appearance of the surface 30 to give the surface 30 a "polished" look.

The pad 5 may be composed of polyester fibers, natural fibers, or other materials known in the art that are durable and reusable. The pad 5 may be provided in the form of a thin disc that substantially mirrors the shape of the pad holder 35, although other shapes for the pad 5 would be appreciated by those skilled in the art. The type of pad 5 used with the burnisher 1 may depend on the type of floor the operator is attempting to clean or polish. For example, burnisher pads composed of a softer material are more effective for polishing hard surfaces.

The components (not illustrated) housed within the body 10 may include, but are not limited to, a power source in electrical communication with one or more electric motors. In some embodiments, the power source may be provided as at least one battery 37. The one or more electric motors may be coupled to the wheels 20, the pad 5, the pad holder 35, and/or other components of the burnisher 1. Using known methods, the at least one battery 37 may provide energy to the one or more electric motors of the burnisher 1. In turn, this energy may be used to actuate or power the wheels 20, the pad 5, the pad holder 35, and/or other components of the burnisher 1.

The one or more electric motors may be coupled to the pad 5 via a drive train comprising a belt and at least one pulley, although other methods of coupling the pad 5 to the one or more electric motors are foreseeable. Further, unlike prior art battery-powered burnishers, the speed of the one or more motors coupled to the pad 5 may change in response to throttling carried out by the operator (via an input device), thereby altering the rotational speed of the pad 5. In addition, the wheels 20 may couple to the one or more electric motors such that the operator need not push the burnisher 1 along the surface 30 to clean the surface 30.

Advantageously, the at least one battery 37 provided with the burnisher 1 may be provided as at least one lithium ion battery. Lithium ion batteries present significant advantages over lead-acid battery packs, including (but not limited to) a higher energy density, a longer battery life per charge, faster charging, and no risk of acid spills. These advantages may make lithium ion batteries safer and more convenient than traditional lead-acid battery packs. Moreover, lithium ion batteries may supply different amounts of power to the one or more electric motors of the burnisher 1, making it possible to rotate the pad 5 at various speeds instead of a single speed when the burnisher 1 is being used. The lithium ion batteries provided with the burnisher 1 may include any type of lithium ion battery that is known in the art including, by way of example, a lithium iron phosphate battery, a lithium manganese oxide battery, a lithium nickel manganese cobalt oxide battery, and/or a lithium nickel cobalt aluminum oxide battery.

In some embodiments, the at least one battery 37 may be provided as a first battery and a second battery. In such embodiments, the first and second batteries may be the same type of battery, or the first and second batteries may be different types of batteries. For example, the first battery may be provided as a lithium ion battery and the second battery may be provided as a 12 V lead-acid battery. As an additional example, the first battery may be provided as a lithium iron phosphate battery, and the second battery may be provided as a lithium manganese oxide battery. In addition, the first and second batteries may power different components of the burnisher 1, or the first and second batteries may power the same components. For example, the first battery may be used to power the at least one electric motor, and the second battery may be used to power a display provided on the burnisher 1. As an additional example, the first and second batteries may both provide power to the one or more electric motors. Other configurations and uses for the at least one battery 37 (including configurations in which more than two batteries are provided) would be appreciated by those having skill in the art.

Figure 4:
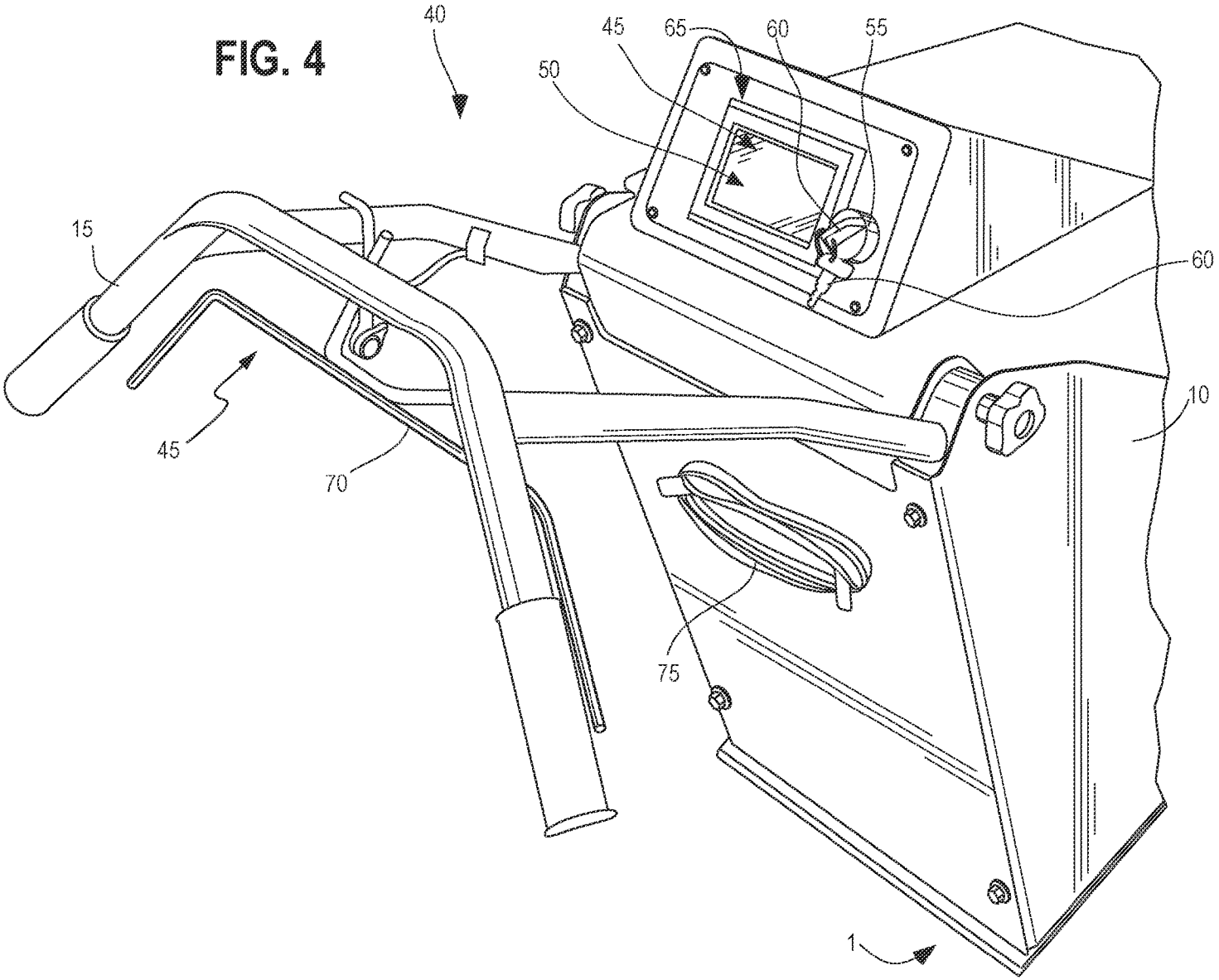
FIG. 4 is a second perspective view of the burnisher of FIG. 3, illustrating a control area of the burnisher.

Turning to FIG. 4, a control area 40 of the burnisher 1 is illustrated. The control area 40 may be at least partly positioned on both the body 10 and the handles 15, or the control area 40 may be positioned and located on one of the body 10 or the handles 15. The control area 40 may include at least one input device 45 that may allow the operator to direct the operations of the burnisher 1. The at least one input device 45 may be provided as mechanically actuated buttons, mechanically actuated switches, capacitive touchscreens, other mechanical or electrical input devices, and/or various combinations thereof as would be appreciated by those skilled in the art. Further, the at least one input device 45 may be coupled to a controller (not illustrated) configured to receive inputs from the at least one input device 45 and use the inputs to direct the behavior of the burnisher 1.

For example, the at least one input device 45 may (directly, indirectly, or via a controller) alter a power output provided to the one or more motors by the at least one battery 37 (not illustrated). For example, via the actuation of at least one input device 45, at least a first power level, a second power level, and a third power level from the at least one battery 37 may be provided to the one or more electric motors. By altering the power levels provided to the one or more electric motors, various performance characteristics of the burnisher 1 may be changed. For example, if the one or more electric motors provides power to the wheels 20 (not illustrated), the first power level may correspond to a first linear movement speed of the burnisher 1, the second power level may correspond to a second linear movement speed of the burnisher 1, and the third power level may correspond to a third linear movement speed of the burnisher 1. As an additional example, if the one or more electric motors provides power to the pad 5 (not illustrated), the first power level may correspond to a first rotational speed of the pad 5 (not illustrated), the second power level may correspond to a second rotational speed of the pad 5, and the third power level may correspond to a third rotational speed of the pad 5. In such embodiments, the first rotational speed may represent an about zero rotational speed, the third rotational speed may represent a maximum rotational speed of the pad 5, and the second rotational speed may be a value between the first and third rotational speeds. In other embodiments, each of the first, second, and third rotational speeds may be nonzero values.

The control area 40 may include at least one output device 50 configured to communicate information to the operator. For example, the at least one output device 50 could inform the operator of the rotational speed of the pad, the charge level of the at least one battery 37, and/or operational warnings. The at least one output device 50 may also provide the operator with information that is not associated with the burnisher 1, such as the local time. The at least one output device 50 may be provided as a mechanically actuated button or switch, a touchscreen display, a light, a speaker, another mechanical or electrical output device, and/or various combinations thereof, as would be appreciated by those skilled in the art.

In some embodiments, the burnisher 1 may include a controller configured to control the automatic processes associated with the burnisher 1. The burnisher 1 may communicate with the controller through a wired and/or a wireless connection. The controller may be in electrical communication with, by way of example, the at least one input device 45, and/or the at least one output device 50. The controller may be provided in the form of a processor and a memory. The memory may include software and data, and the memory may be designed for storage and retrieval of information to be processed by the processor. The processor includes an input configured to receive process signals (e.g., process signals generated by the at least one input device 45). The controller may operate autonomously or semi-autonomously, may read executable software instructions from the memory or a computer-readable medium (e.g., a hard drive, a CD-ROM, flash memory), and/or may receive instructions via the input from the user or another source logically connected to a computer or device, such as another networked computer or server. For example, the server may be used to control the burnisher 1 or the via the controller on-site or remotely.

The processor may process the process signals provided as the input to generate an output. The output may take the form of a process control action. Example process control actions may include sending a signal to the electric motors, the pad 5, the at least one output device 50, and/or any other automatically controllable components of the burnisher 1. Other example process control actions may include adjusting speed of the pad 5, computing the power level of the at least one battery 37, computing an elapsed time that the burnisher 1 has been in operation, and the like.

The control area 40 may include a key switch 55 positioned and located on the body 10 of the burnisher 1, although other locations for the key switch 55 are foreseeable. The key switch 55 may be used to energize or de-energize the burnisher as the operator desires. A key (e.g., a key 60) used in conjunction with the key switch 55 may be unique to the burnisher 1 to help prevent an unauthorized operator from activating the burnisher 1.

A display 65 may also be provided on the body 10. The display 65 may be positioned and located near the key switch 55 or elsewhere in the control area 40 as would be appreciated by those skilled in the art. In the illustrated embodiment, the display 65 is provided as a touchscreen display that may receive operator inputs and provide various outputs. The operator inputs may then direct various operations of the burnisher 1, including, but not limited to, the rotational speed of the pad 5 and the travel speed of the burnisher 1. In alternative embodiments of the invention, the display 65 may be provided as an analog display device where information about the vehicle is communicated via mechanically actuated instruments such as dials.

The control area 40 may include a bail 70 that can be coupled to the handles 15 in a variety of foreseeable manners. For example, the bail 70 may be rotatably coupled to the handles 15 such that the bail 70 can rotate towards and away from the handles 15. In this embodiment, when the bail 70 is squeezed toward the handles 15, a switch (not illustrated) may be pressed and engaged by the bail 70. When the switch is engaged, a motor of the one or more electric motors and/or the pad 5 may begin to rotate. If the operator releases the bail 70, the bail 70 may rotate away from the handles 15 and disengage the switch. When the switch is disengaged, the motor may be deactivated and the pad 5 may stop rotating.

The control area 40 may also include a power cord 75. The power cord 75 may be coupled to the at least one battery 37 housed within the interior of the body 10. The power cord 75 may allow the at least one battery 37 to be recharged if the power cord 75 is plugged into a standard wall outlet or a dedicated charger, as would be appreciated by those skilled in the art.

Figure 5:
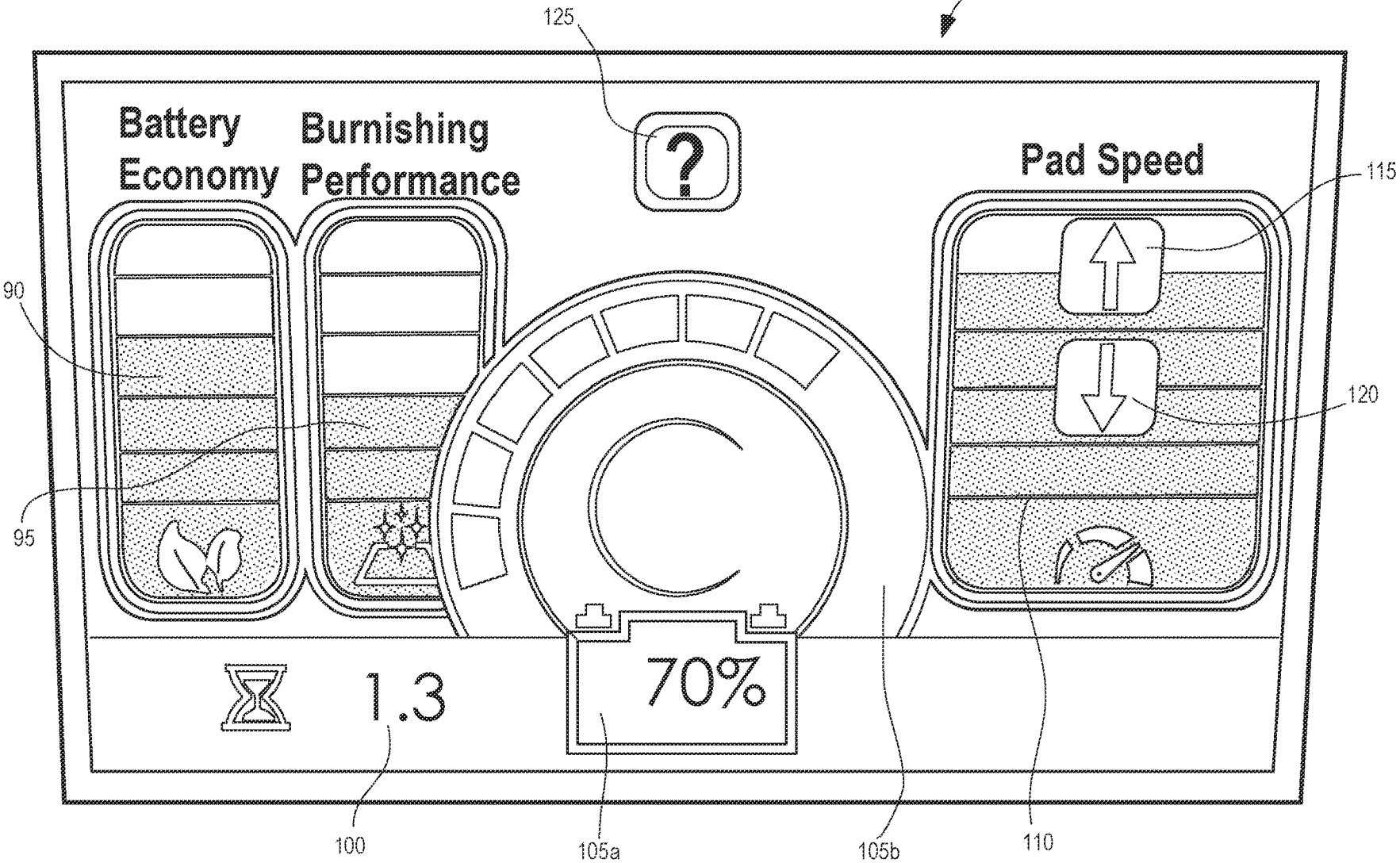
FIG. 5 is a perspective view of a touchscreen display positioned within the control area of the burnisher of FIG. 4.

An embodiment of the display 65 is further illustrated in FIG. 5. The display 65 provides a means via which the operator may interact with the controller (not illustrated) and the controller may communicate information to the burnisher 1 operator. The at least one input device 45 and the at least one output device 50 may be incorporated into the display 65. As described above, the at least one input device 45 and the at least one output device 50 may be mechanical or electrical in nature. The at least one input device 45 and the at least one output device 50 may include mechanically actuated buttons, mechanically actuated switches, knobs, dials, lights, speakers, LCD displays, LED displays, OLED displays, touchscreen displays, and/or other input and output devices as would be appreciated by those skilled in the art.

The display 65 may display outputs related to battery economy, battery life, and performance of the burnisher 1. For example, the display 65 may include a battery economy output 90 and a burnishing performance output 95. In some embodiments, the outputs 90, 95 may be the inverse of each other such that the outputs 90, 95 increase and decrease relative to each other at the same rate. In other embodiments of the invention, the outputs 90, 95 may not be directly correlated but may be influenced by other parameters, such as the amount of time the pad 5 is activated or the time between charges of the burnisher 1. Other parameters may be incorporated into the outputs 90, 95 as would be foreseeable to one skilled in the art.

The display 65 may also include additional outputs, such as an hour meter 100, battery state of charge indicators 105*a* and 105*b*, and a pad speed indicator 110. The outputs may be configured by the burnisher manufacturer to provide real-time data to the burnisher operator. For example, the hour meter 100 may communicate how long the burnisher has been in operation (e.g., in hours) during its current use and/or its lifetime. The battery state of charge indicators 105*a* and 105*b* may provide information regarding the charge state of the battery in a numerical form (e.g., an amount of a charge remaining before the complete discharge of the at least one battery 37) or in a graphical form (e.g., an indicator that empties and fills based on the charge of the at least one battery 37 and/or color-coding indicating the charge of the at least one battery 37). Generally, the pad speed indicator 110 may indicate how fast the pad 5 is spinning and/or provide an input interface wherein the operator can alter the rotational speed of the pad 5. For example, the pad speed indicator 110 may provide the operator raw data related to how fast the pad 5 is spinning (e.g., the rotational speed in rotations per second or rotations per minute). The pad speed indicator 110 may also transform the raw data into a visual display that can be interpreted by the operator, such as a speedometer or a graphic that fills and empties as the rotational speed of the pad 5 changes.

The display 65 may also provide at least one input device 45 that allow the operator to adjust the rotational speed of the pad 5. For example, in the illustrated embodiment, the pad speed indicator 110 includes a first arrow 115 and a second arrow 120 that may respond to the operator's touch via known mechanisms. The first arrow 115 may increase the rate at which the pad 5 rotates, while the second arrow 120 may decrease the rate at which the pad 5 rotates. The burnisher 1 may include built-in limitations regarding the amount the speed of the pad 5 can be adjusted. For example, the built-in limitations may help ensure that the rotational speed of the pad 5 does not exceed a predetermined threshold value. Such built-in limitations may be mechanical in nature or controlled by the controller, as would be appreciated by those skilled in the art. The built-in limitations may be implemented to prevent damage to the burnisher 1, and/or help ensure that the pad 5 maintains an appropriate rotational speed for burnishing.

The display 65 may also include a help button 125 to assist the operator in resolving issues that may arise during operation of the burnisher 1. For example, such issues may include a slowing rotational speed of the pad 5 during operation; an increased difficulty in pushing the burnisher 1 forward; or an inability to activate the pad 5. The button 125 may be context sensitive such that, when the operator presses the button 125, the display 65 provides the operator with information to address a problem detected by the controller of the burnisher 1. For example, if rotational speed of the pad 5 decreases during use, the button 125 may inform the operator that full power cannot be supplied to the pad 5 when the one or more batteries of the burnisher 1 are near full discharge. As an additional non-limiting example, if the controller detects that the pad 5 is decoupled from the pad holder 35 (thereby preventing the operator from rotating the pad 5), the display 65 may inform the operator that the pad 5 is decoupled from the burnisher 1. In other configurations, the button 125 may not be context sensitive. In such configurations, the button 125 may present a menu of options on the display 65 that the operator can access to learn more about the burnisher 1, including various troubleshooting fixes. In other embodiments of the invention, the button 125 may include both context-sensitive and non-context-sensitive features as would be appreciated by those skilled in the art.

As is evident from the foregoing description, certain aspects of the present invention are not limited by the particular details of the examples illustrated herein, and it is therefore contemplated that other modifications, applications, variations, or equivalents thereof, will occur to those skilled in the art. Many such changes, modifications, variations and other uses and applications of the present constructions will, however, become apparent to those skilled in the art after considering the specification and the accompanying drawings. In addition, unless mention was made above to the contrary, it should be noted that all of the accompanying drawings are not to scale. All such changes, modifications, variations and other uses in applications which do not depart from the spirit and scope of the present inventions are deemed to be covered by the inventions which are limited only by the claims which follow.

The invention claimed is:

1. A variable-speed burnisher comprising:

a body housing at least one battery and one or more motors, wherein at least a first battery of the at least one battery is a lithium iron phosphate battery, and the at least one battery is configured to provide at least a first power level, a second power level, and a third power level to the one or more motors;

a pad coupled to the body, wherein the pad is configured to rotate at a speed of at least 1,000 rotations per minute during operation of the variable-speed burnisher;

a control area including:

a handle protruding outwardly and away from the body;

a display, wherein the display is configured to show at least one output designed to provide real-time data related to the variable-speed burnisher, the at least one output including:

a first output provided as a first battery state of charge indicator;

a second output provided as a pad speed indicator; and a third output provided as an hour meter;

at least one input device including:

a first input device coupled to the handle, wherein, when the first input device is moved toward the handle, the pad begins rotating;

a second input device in communication with the at least one battery and the one or more motors, the second input device designed to throttle the one or more motors to alter a rotational speed of the pad from a first, non-zero rotational speed to a second, non-zero rotational speed, and increments therebetween; and a third input device provided in the form of a key switch configured to energize and de-energize the variable-speed burnisher.

2. The variable-speed burnisher of claim 1, wherein the at least one battery further includes a second battery, and the first battery and the second battery are the same type of battery.

3. The variable-speed burnisher of claim 2, wherein the at least one output further includes a fourth output provided as a second battery state of charge indicator.

4. The variable-speed burnisher of claim 1, wherein the display is provided as a capacitive touchscreen.

5. The variable-speed burnisher of claim 1, further including a controller in communication with the at least one input device and the at least one output device, and wherein the controller is configured to:

determine a power level of the at least one battery;

determine an elapsed time the variable-speed burnisher has been in operation; and execute programming to alter the speed of the pad based at least partially on an input received via the second input device.

6. The variable-speed burnisher of claim 5, wherein the second input device is provided in the form of a dial.

7. A variable-speed burnisher comprising:

a body including a motor coupled to a pad holder, the pad holder configured to retain a burnisher pad, wherein the motor is designed to rotate the burnisher pad at a plurality of rotational speeds;

a first rechargeable lithium iron phosphate battery and a second rechargeable lithium iron phosphate battery in electrical communication with the motor;

a handle coupled to and extending away from the body;

a display coupled to the body, the display designed to convey information related to a burnisher performance, a battery state of charge, a pad speed in at least one of a numerical form and a graphical form, and operational warnings;

one or more input devices including:

a first input device configured to energize the burnisher;

a second input device coupled to the handle, wherein, when the second input device is actuated, the burnisher pad begins to rotate;

a third input device;

a controller in electrical communication with the one or more input devices, the motor, and the display, the controller configured to:

adjust a rotational speed of the burnisher pad based on actuation of the third input device; and provide an output to the display.

8. The variable-speed burnisher of claim 7, wherein actuation of the third input device is designed to allow a user to selectively vary the rotational speed of the burnisher.

9. The variable-speed burnisher of claim 7, wherein the controller is configured to prevent the rotational speed of the variable-speed burnisher from exceeding a predetermined threshold value.

10. The variable-speed burnisher of claim 7, wherein the display further includes one or more output devices, the one or more output devices including:

a first output device provided in the form of a first battery state of charge indicator, a second output device provided in the form of a second battery state of charge indicator, a third output device provided in the form of a pad speed indicator, a fourth output device provided in the form of an hour meter, wherein the controller is further configured to provide a first output to the first output device, a second output to the second output device, a third output to the third output device, and a fourth output to the fourth output device.

11. The variable-speed burnisher of claim 10, wherein:

the pad speed indicator provides raw data related to the rotational speed of the burnisher pad and a visual indication designed to indicate the rotational speed of the burnisher pad, the first and second battery state of charge indicators provide information related to a charge state of the first and second batteries.

12. The variable-speed burnisher of claim 7, wherein the plurality of rotational speeds includes at least a first non-zero rotational speed, a second non-zero rotational speed, and a third non-zero rotational speed, wherein the first non-zero rotational speed is at least 1,000 rotations per minute.

13. The variable-speed burnisher of claim 7, wherein the controller is configured to alter a power output provided to the motor, wherein the power output includes at least a first power output, a second power output, and a third power output.

14. The variable-speed burnisher of claim 7, wherein the display is provided as a touchscreen display.

15. A variable-speed burnisher comprising:

a power source provided as at least one lithium ion rechargeable battery;

a motor in electrical communication with the power source; and a control area including at least one input device and at least one output device, wherein the at least one input device includes a first input device provided as a throttle designed to change a rotational speed of a pad coupled to the motor in response to throttling initiated by a user, and the at least one rechargeable lithium ion battery is designed to adapt an amount of energy applied to the motor; wherein the first input device is provided in the form of a dial, the at least one input device includes a second input device provided in the form of a key switch designed to energize the burnisher and de-energize the burnisher, and when the key switch is actuated to energize the burnisher, via the first input device, at least a first power level, a second power level, and a third power level can be provided to the motor.

16. The variable-speed burnisher of claim 15, wherein the at least one rechargeable lithium ion battery includes a first rechargeable lithium ion battery and a second rechargeable lithium ion battery.

17. The variable-speed burnisher of claim 15, wherein the first power level corresponds to a first rotational speed of the pad, the second power level corresponds to a second rotational speed of the pad, and the third power level corresponds to a third rotational speed of the pad, and the first rotational speed is at least 1,000 rotations per minute.

18. The variable-speed burnisher of claim 15, wherein the at least one output device includes a help button, and wherein the help button provides the user with troubleshooting options related to operation of the burnisher.

19. The variable-speed burnisher of claim 15, wherein the at least one input device is configured to provide a fourth power level to the motor.

* * * * *